US005951780A

United States Patent [19]

Pettigrew

[11] Patent Number: 5,951,780

[45] Date of Patent: Sep. 14, 1999

[54] SURFACE TREATMENT METHOD AND APPARATUS INCLUDING BRUSH MEANS AND IMPACT MEANS MOUNTED ON A SINGLE SHAFT

[76] Inventor: Rodney Mackenzie Pettigrew, Unit 6, Cnr Whitmore & Campbell Streets, Taringa, Australia, QLD 4068

[21] Appl. No.: 08/765,981

[22] PCT Filed: Jul. 20, 1994

[86] PCT No.: PCT/AU94/00408

§ 371 Date: Jan. 17, 1997

§ 102(e) Date: Jan. 17, 1997

[87] PCT Pub. No.: WO95/03455

PCT Pub. Date: Feb. 2, 1995

[30] Foreign Application Priority Data

Jul. 20, 1993 [AU] Australia ..... PM 0056

[51] Int. Cl.[6] ..... E01H 1/02

[52] U.S. Cl. ..... 134/6; 134/9; 134/15; 134/21; 134/32; 134/33; 15/4; 15/5; 15/41.1; 15/355; 15/356; 15/366; 15/141.2

[58] Field of Search ..... 134/6, 9, 15, 21, 134/32, 33; 15/4, 5, 141.2, 355, 356, 366, 41.1

[56] References Cited

U.S. PATENT DOCUMENTS

| | | | |
|---|---|---|---|
| 1,624,247 | 4/1927 | Hoover . | |
| 2,512,544 | 5/1950 | Hammell | 15/141.2 |
| 3,748,675 | 7/1973 | Schultz | 15/4 |
| 3,758,915 | 9/1973 | Zeski et al. | 15/5 |
| 4,063,961 | 12/1977 | Howard et al. | 134/4 |
| 4,209,873 | 7/1980 | Schaefer | 15/366 |
| 4,349,936 | 9/1982 | Lorson et al. | 15/5 |
| 4,480,349 | 11/1984 | Barr | 15/4 |
| 4,542,556 | 9/1985 | Hepple | 15/321 |
| 4,799,286 | 1/1989 | Rubin | 15/355 |
| 4,825,495 | 5/1989 | Van Ginhoven et al. | 15/5 |
| 5,018,240 | 5/1991 | Holman | 15/349 |
| 5,218,732 | 6/1993 | Pettigrew et al. | 15/5 |
| 5,249,328 | 10/1993 | Shin | 15/5 |
| 5,287,591 | 2/1994 | Rench et al. | 15/328 |
| 5,404,609 | 4/1995 | Rench et al. | 15/52.1 |

*Primary Examiner*—Lyle A. Alexander
*Assistant Examiner*—S. Carrillo
*Attorney, Agent, or Firm*—Young & Thompson

[57] ABSTRACT

Surface treatment apparatus having impact elements for impacting a surface to be treated, a brush element for brushing the surface, a drive device for operating the impact element and the brush elements, and a carriage device enabling the surface treatment apparatus to be moved across the surface to be treated. The brush elements include a composite rotary brush assembly having circumferentially spaced rows of bristles mounted on a rotatable shaft in alternate circumferential sequence with the impact elements and further rotary assembly mounted on a contra-rotation relative to the composite rotary brush assembly and/or the impact elements, each rotatable so their bristles move upwardly intermediate the respective shafts. The impact elements include a plurality of longitudinal spaced hammers each pivotable about an axis substantially parallel to the axis of the rotatable shaft. The surface treatment apparatus may also include height adjustment elements for adjusting the engagement between the impact elements and the brush elements with a surface to be treated, and may further include an induction device for inducting a flow of brushed particulate material to a discharge through an upstanding duct. In use, brushed particulate material is lifted above the surface and separated from the surface based on the density of the brushed particulate material.

15 Claims, 5 Drawing Sheets

SURFACE TREATMENT METHOD AND APPARATUS INCLUDING BRUSH MEANS AND IMPACT MEANS MOUNTED ON A SINGLE SHAFT

CROSS-REFERENCES TO RELATED APPLICATIONS

The application is the 35 USC §371 national stage application of international application PCT/AU94/00408 filed on Jul. 20, 1994, which designated the United States of America.

BACKGROUND OF THE INVENTION

This invention relates to a surface treatment method and apparatus.

This invention has particular but not exclusive application to surface treatment apparatus for treating and/or rejuvenating the playing surfaces of sporting facilities, and for illustrative purposes reference will be made to such application. More particularly the invention has particular reference to playing surfaces covered with artificial grass or turf. However, it is to be understood that this invention could be used in other applications, such as in the surface treatment of paved, painted or carpeted playing surfaces of sporting facilities are

DESCRIPTION OF THE RELATED ART

The playing surfaces of sporting facilities are frequently provided with a surface material which mimics the look of grass or turf, but gives a superior grip to prevent players skidding on the surface, and/or superior resilience to decrease the extent of injury should a player fall on the surface.

Frequently, the artificial turf is constructed of a hispid mat with the pile of the mat made up of blade like elements mimicking the colour and/or shape of blades of grass. Typically, the pile is fixed into a backing sheet to form a mat assembly, and the backing sheet and pile is embedded in a layer of sand, with the pile projecting upwardly from the sand.

Artificial turf surfaces degrade over a period of time by a combination of processes including laying down of the upwardly projecting pile elements, intrusion of foreign matter into the pile and/or the sand, build up of bacteria, slime or mould or deterioration of the drainage ability of the playing surface. Paved surfaces are also rendered unattractive and dangerous as they deteriorate with time. Accordingly such surfaces, require rejuvenation.

SUMMARY OF THE INVENTION

The present invention aims to provide surface treatment apparatus which will be reliable and efficient in use.

With the foregoing in view this invention in one aspect resides broadly in surface treatment apparatus including:

- impact meads for impacting a surface to be treated to dislodge particulate material;
- brush means for brushing the surface to lift the dislodged particulate material to provide brushed particulate material;
- drive means for operating the impact means and the brush means;
- induction means for entraining a flow of brushed particulate material to the discharge means;
- separation means for separating lighter brushed particulate material from heavier brushed particulate material, the heavier particulate material being returned to the surfacer, and

- carriage means to enable the surface treatment apparatus to be moved across the surface to be treated.

As used herein, the term "impact" has its ordinary meaning of the striking of one body on another and is to be distinguished from a scraping action.

Preferably, the brush means includes a composite rotary brush assembly having circumferentially spaced rows of bristles mounted on a rotatable shaft in alternate circumferential sequence with the impact means. Alternatively, the brush means may include spirally wound bristles or radially disposed bristles with impact means interposed at selected intervals. The impact means may be supported remote from the brush means.

However, the impact means is preferably pivotally mounted upon the rotatable shaft whereby the impact means includes a plurality of longitudinally spaced hammers each pivotable about an axis substantially parallel to the axis of the rotatable shaft.

In a further alternative, the impact means may be a projection extending outwardly from the rotating shaft to which the brush means is operatively attached. The impact means may be constituted by a plurality of resilient blocks substantially in the form of a rectangular prism. Suitably, the blocks are manufactured of a material which is tough and abrasion resistant, such as polyurethane or such like.

In a preferred embodiment of the invention, the brush means includes a further rotary brush assembly mounted for contrarotation relative to the composite rotary brush assembly and/or the impact means. Suitably the further rotary brush assembly and the composite rotary brush assembly are mounted on spaced transverse shafts disposed substantially parallel to one another. Moreover, the composite rot brush assembly and the further rotary brush assembly preferably each rotate so their bristles move upwardly intermediate the respective shafts.

The surface treatment apparatus may also include height adjustment means for adjusting the engagement between the impact means and the brush means with a surface to be treated. Preferably, the height adjustment means is operable to selectively vary the height of the composite rotary brush assembly and/or the impact means and the further rotary brush assembly.

Additionally, the surface treatment apparatus preferably includes induction means for inducing a flow of brushed particulate material to discharge means. The induction means preferably includes a particle inlet substantially intermediate the composite and further rotary brush assemblies, an induction path leading to a blower assembly, and a blower outlet constituting the discharge means. Preferably, the induction path includes an upstanding duct which is formed by a tube connected between the particle inlet and the blower assembly.

The induction means is so formed and arranged so that, in use, brushed particulate material is lifted above the surface to be treated to an elevation relative to the density of the brushed particulate material and lighter brushed particulate material is separated from heavier brushed particulate material by separation means included in the induction path. Preferably, the separation means includes collection means for collecting separated lighter brushed particulate material.

In another aspect, this invention resides in a method of surface treatment including:

- providing surface treatment apparatus as hereinbefore described;
- operating the brush means and the impact means, and
- adjusting the engagement between the impact means and the brush means with the surface to be treated;

passing the surface treatment apparatus over the surface to be treated at a speed sufficient to permit dust, debris and other detritus to be removed from the brushed particulate material.

The method may further include:

adjusting the engagement between the composite brush means with the surface to be treated so that the impact means is substantially disengaged from the surface;

adjusting the engagement between the further brush means with the surface to be treated so that the brush means is engaged with the surface, and making a second passage of the surface treatment apparatus over the surface to be treated at a speed sufficient to permit the brushed particulate material to be substantially evenly distributed over the surface.

The surface to be treated may include an artificial turf surface having upstanding pile, and the second passage substantially returns the brushed particulate material between the upstanding pile of the artificial turf surface.

The induction means may be used for forming a lowered pressure adjacent the surface to be treated or rejuvenated in the vicinity of the contact between the surface and the impact means and brush means whereby extraneous material may be conveyed from the surface being treated. Preferably, the lowered pressure is between two contra-rotating brush assemblies.

The surface treatment apparatus may also include washing means for applying a washing medium including water and/or detergent or such like to the surface and/or the brushes.

The surface treatment may be selectively varied such as by controlling the speed of rotation of the impact means and brush means and/or the capacity of the induction apparatus, or by controlling the speed of carriage across the surface being treated. The impact effect of the impact means may be varied such as by selectively varying the height of the rotary shaft and thus the potential intrusion of the impact means into the surface.

In a preferred arrangement, there is provided a forward rotor which includes impact means and brush means and a rear rotor which includes brush means only, and the speed of each rotor is adjusted so that, in use, the beating action of the impact means cracks the surface (in a rejuvenation process where such has become hardened) and the draught action of the rotors segregates the infill sand from algae and other contaminants. Because most of the contaminants have a lower density in air than the infill sand, they are drawn into the vacuum chamber and collected.

The brush assemblies are suitably mounted in a chassis having independent height control of front and rear axles with wheels mounted thereon for movement of the surface treatment apparatus.

On final dress out of an artificial turf, the front of the chassis may be raised so that the rotor acts to level out unevenness in the infill sand left on the surface.

The chassis may also be powered from the motor driving the rotors, and the construction of tee chassis may be modular so that two or more surface treatment apparatus may be operatively linked to work side-by-side. Additionally, a trailing levelling blade may be provided.

In a particular example, where surface to be treated is composed of artificial grass having sand associated therewith, the associated dust, debris and other detritus together with at least some of the sand may be thrown upwardly by the action of the rotatable brush means and the impact means ,into a space intermediate the rotatable brush means whereupon the associated dust, debris and other detritus may be separated from the sand by the vacuum means and deposited into a dust receptacle, whilst the sand is permitted to fall back to the surface under treatment.

BRIEF DESCRIPTION OF THE DRAWINGS

In order that invention may be more readily understood and put into practical effect, reference will now be made to the accompanying drawings which illustrate typical embodiments of the invention and wherein.

DETAILED DESCRIPTION OF THE INVENTION

Figure 1:
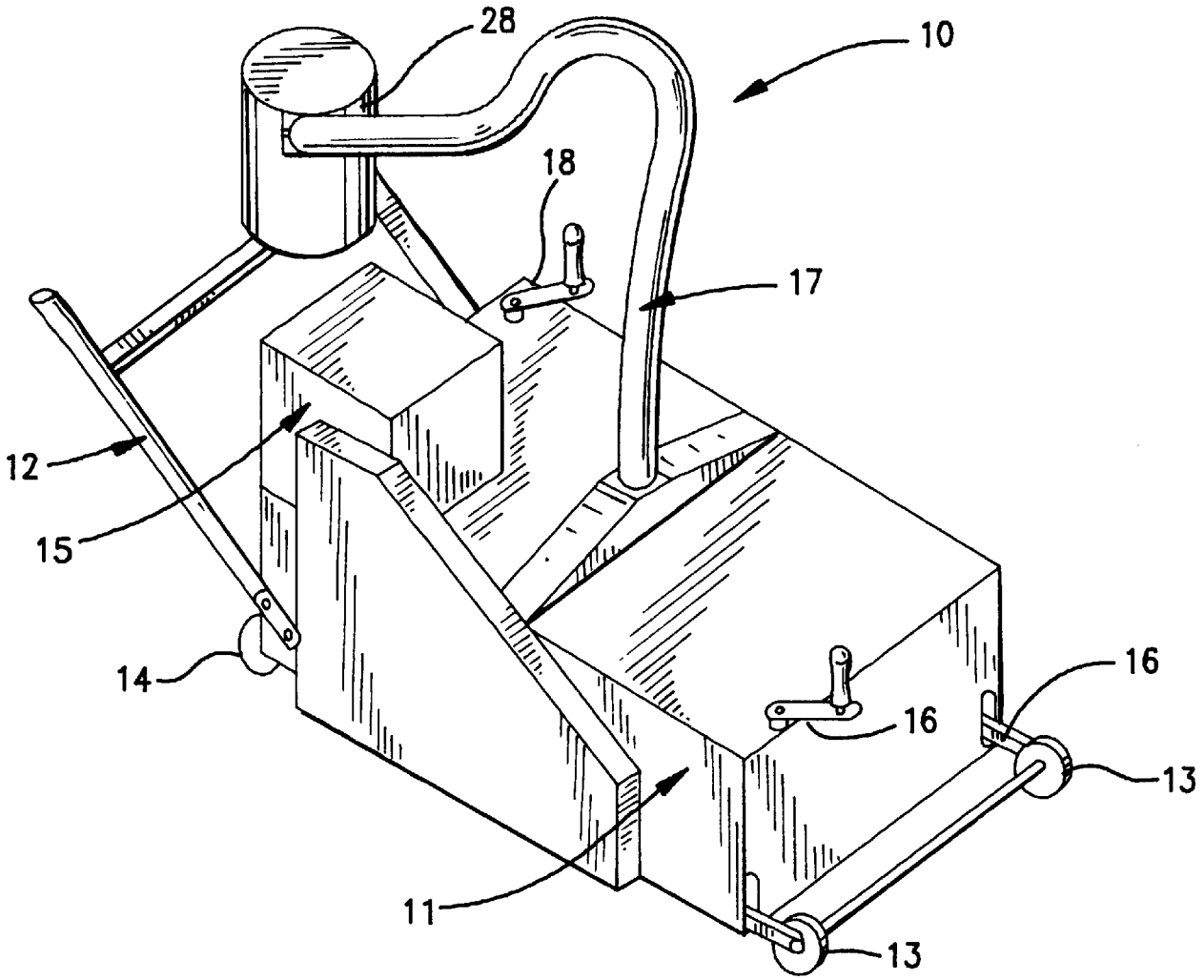
FIG. 1 is perspective view of a surface treatment apparatus.

Referring to FIG. 1, a surface treatment apparatus 10 includes a housing 11 and a handle 12 extending rearwardly therefrom. The surface treatment apparatus 10 also has two front wheels 13 and two rear wheels 14 on the base of the housing 11, a motor housing 15 on the top of the housing 11 and a blower assembly 28 mounted on the handle 12.

Figure 2:
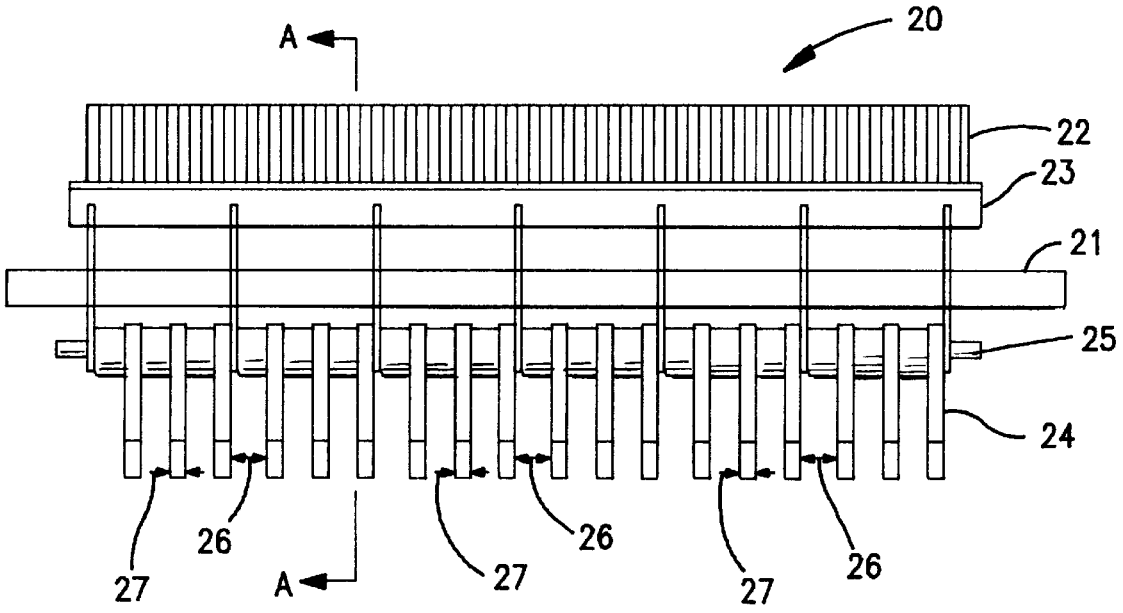
FIG. 2 is a diagrammatic representation of the front view of a rotatable shaft according to one embodiment of this invention.
Figure 3:
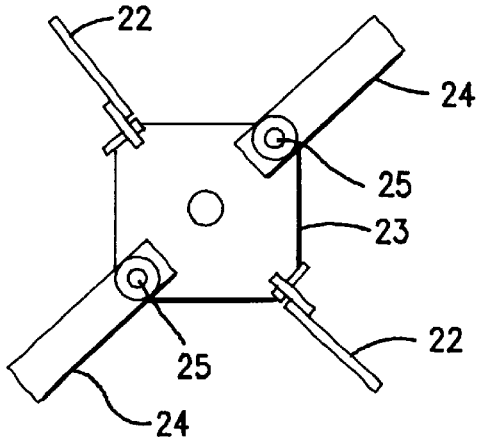
FIG. 3 is a diagrammatic representation a sectional view of the rotatable shaft of FIG. 2.

Referring to FIGS. 2 and 3, a composite shaft assembly 20 includes a main shaft 21 upon which is mounted a mounting frame 23. The mounting frame 23 has two brushes 22 and a plurality of swing hammers 24 mounted on respective opposed sides of the mounting frame 23 so that the two brushes 22 are diametrically opposed to each other and the sets of hammers 24 are diametrically opposed to each other.

Figure 4:
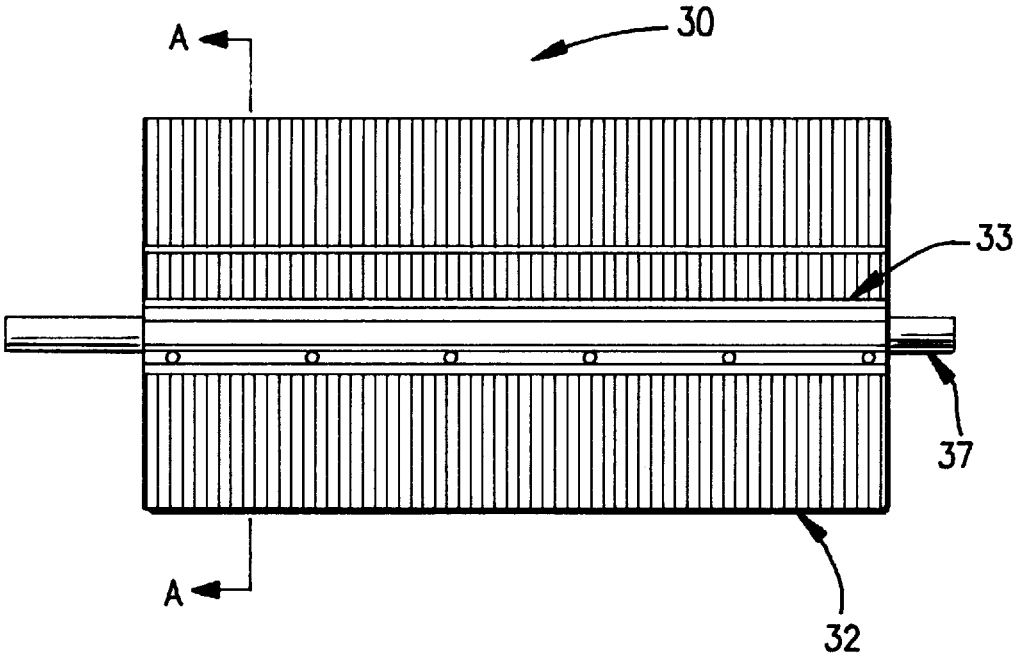
FIG. 4 is a diagrammatic representation of the front view of a rotatable shaft according to another embodiment of this invention.
Figure 5:
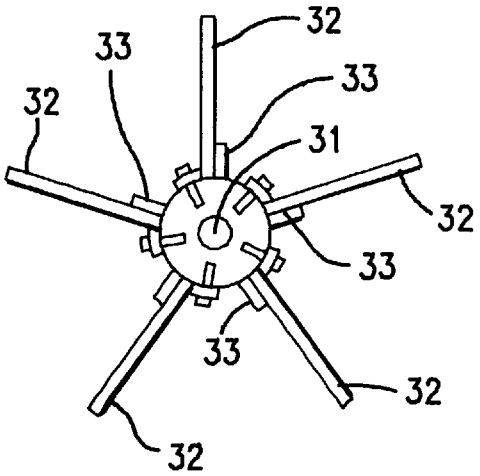
FIG. 5 is a diagrammatic representation a sectional view of the rotatable shaft of FIG. 4.

Referring to FIGS. 4 and 5, a further shaft assembly 30 includes a mounting frame 33 and brush mounted thereon with a plurality of brushes 32 attached to the mounting frame 33. Both shaft assemblies 20 and 30 are mounted in the surface treatment apparatus 10, the further shaft assembly 30 preferably being used as a second surface treatment means following behind the composite shaft assembly 20.

The front wheels 13 include a front height adjustment to adjust the interference of the hammers and brushes with the surface to be treated and allow for wear of the swing hammers 24 and/or brushes 22.

The rear wheels 14 include a rear height adjustment 18 to adjust the intererence of the brushes with the surface to be treated and allow for wear of the brushes 32.

The swig hammers 24 are spaced apart by a hammer spacing 26 and have a hammer width 27 equal to the hammer spacing 26 with each respective set of swing hammers 24 being arranged so that the swing hammer 24 of one set is diametrically opposite the hammer spacing 26 of the other set. Each swing hammer 24 pivots on a hammer pivot 25 on the mounting frame 23.

Figure 6:
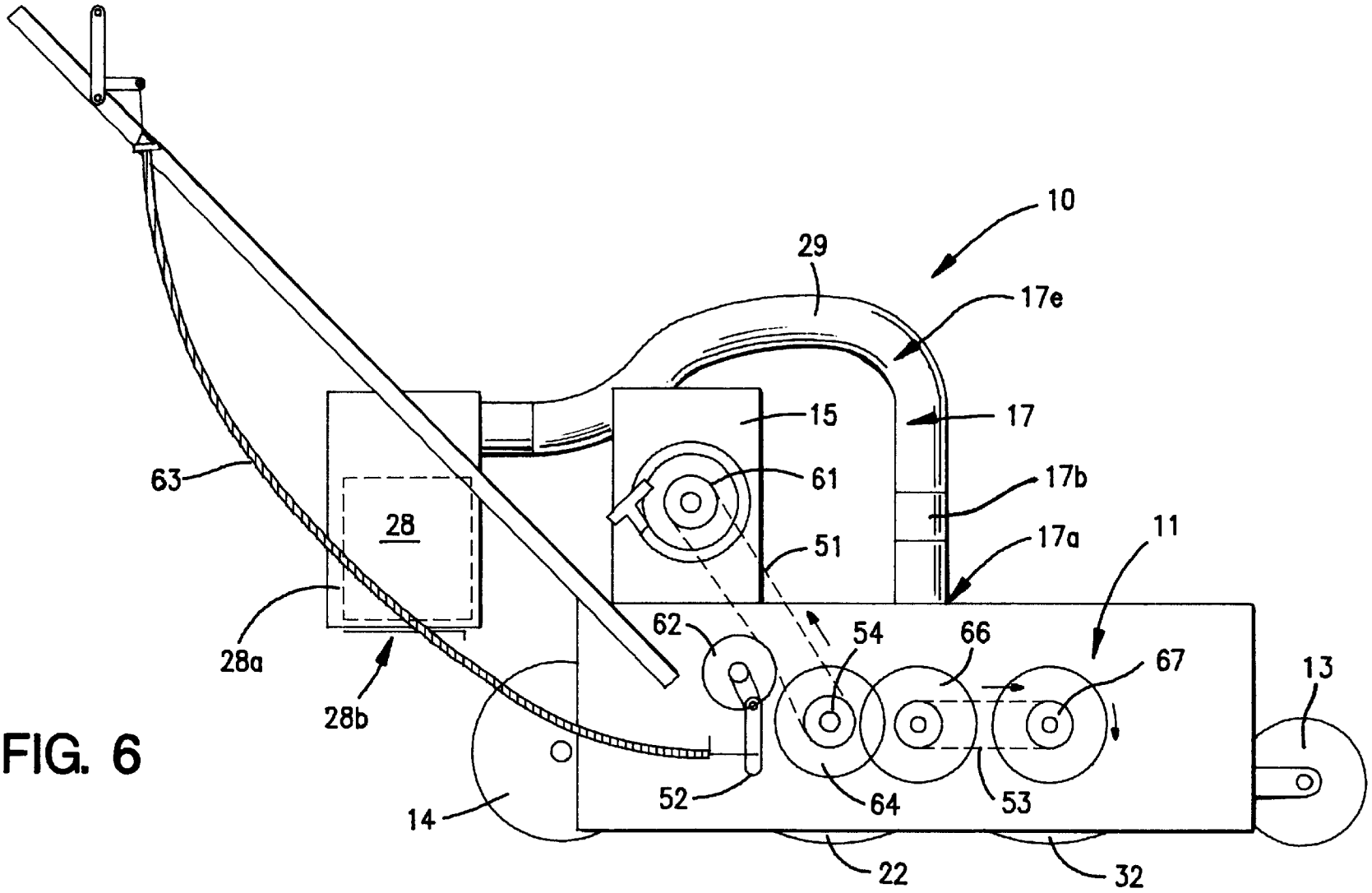
FIG. 6 collectively shows schematically the internal workings of the apparatus from the side.

Referring to FIG. 6, the surface treatment apparatus 10 includes a canister and blower assembly 28 for receiving air.

The blower creates a negative pressure about the brushes and swing hammers whereby light material beaten from the sand particles is drawn into a removable canister portion 28*a* of the canister and blower assembly 28 and a raised portion 29 is provided for this purpose. The induction means includes a particle inlet 17*a,* separation means 17*b,* upstanding duct 17*e* to elevate the lighter particulate material (not shown) to the raised portion 29 leading to blower assembly 28. The blower assembly 28 contains the collection means in the form of the removable canister 28*a* and a blower outlet 28*b* serving as the discharge means.

A drive pulley 61 is driven by the motor in the motor housing 15. The, drive pulley 61 drives a rear belt 51 against a clutch pulley 62. A clutch cable 63 is operable to rotate a clutch lever 52 to engage and disengage the clutch pulley 62 with the rear belt 51. When engaged, the rear belt drives a rear pulley 64 to drive the composite brush assembly.

The rear pulley also has a capstan 54 against which a reversing pulley 66 is driven. The reversing pulley 66 drives a forward pulley 67 through a forward belt 53. The further brush assembly is driven by the forward pulley 67. The belts and pulleys are driven in the direction shown by the indicating arrows.

Figure 7:
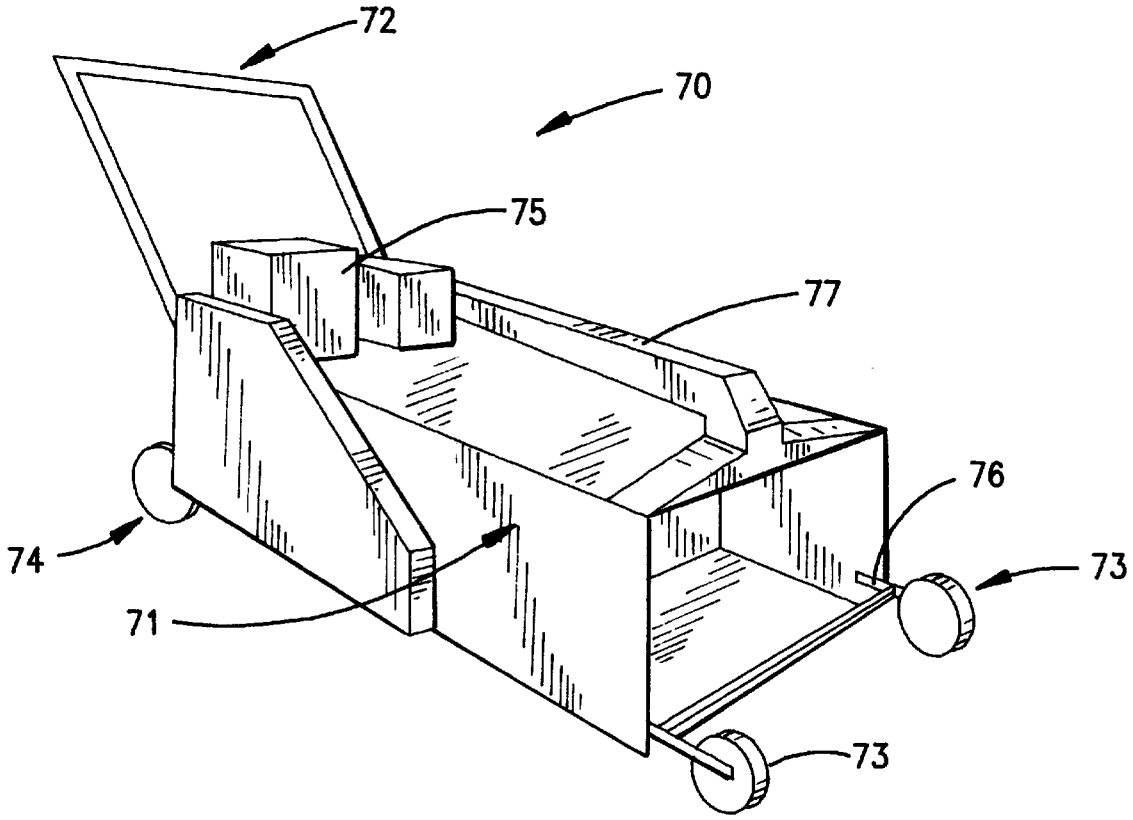
FIG. 7 shows an alternative surface treatment apparatus with the front panel and composite brush assembly removed for clarity.

Referring to FIG. 7, an alternative surface treatment apparatus 70 includes a housing 71 and a handle 72 extending rearwardly therefrom. The surface treatment apparatus 70 also has two front wheels 73 and two rear wheels 74 on the base of the housing 71 and a motor housing 75 on the top of the housing 71.

The alternative surface treatment apparatus 70 includes a single composite brush assembly such as shown in respect of FIGS. 2 and 3 and is rotated in reverse to the direction of forward travel of the alternative surface treatment apparatus 70. A vacuum blower 77 draws material upwardly from the front of the alternative surface treatment apparatus 70.

In use, the surface treatment apparatus of this invention may be constructed as hereinbefore described and used to treat the artificial turf surface on a playing field such as a tennis court. Typically, the apparatus is placed on the surface and the motor started to cause the shaft assemblies 20 and/or 30 to rotate. Suitably, the direction of rotation is with the top or the rotor or rotors towards the rear of the apparatus.

The apparatus may be pushed by hand or power assisted drive provided.

Typically, the rotatable shaft or shafts are rotatable at a speed of from 750 rpm to 1500 rpm. Preferably, the rotation is in the range of from 800 rpm to 1200 rpm, and more preferably, selectable to either 800 rpm or 1200 rpm. The forward motion speed of the surface treatment apparatus is geared according to the speed of the motor rotating the rotatable shaft, and is in the range of 2 kph to 8 kph. Preferably, speed is in the range of from 3 kph to 6 kph, and more particularly, selectable to either 3 kph or 6 kph.

Thus, the strike rate of the swing hammers is in the range of from 8 impacts per meter to 32 impacts per meter.

The height adjustment 16 is used to bring the swing hammers 24 and brushes 22 into contact with the surface to be treated and to a level sufficient to treat this surface of the artificial turf as desired such as to break up any encrustation of the sand intermediate the fibres of the artificial turf. Suitably, the height of the hammers and brushes is set to be from 1 mm to 5 mm below the surface of the sand.

Where two rotors are provided, the rear rotor is preferably operated in the range of from 300 rpm to 1000 rpm and the front rotor in the range of from 45 rpm to 150 rpm. Preferably, the drive is accomplished using belts and pulleys, although other means such as hydraulic drives may be utilised.

If desired, the surface treatment apparatus may include side brushes rotatable about inclined or vertical axes for sweeping the surface towards the main brush assemblies. Additionally, a front clutch mechanism may be provided to electively disengage the front brush assembly whilst the rear brush assembly is still engaged.

Where a larger surface is to be treated a larger version of the surface treatment apparatus may he provided adapted for attachment to a tractor or such like. For example, the carriage means may be a standard three point linkage attachment and the drive means may be an operative connection for the tractor's power take-off.

Although a caster action may be provided on the front or rear wheels, it is preferred that the wheels are in alignment with the surface treatment apparatus 10. The apparatus 10 may be driven by the motor that drives the rotatable shafts or be pushed by a user pushing on the handle 12. The surface treatment apparatus may be used to treat the entire surface by driving the apparatus back and forth across the playing surface, the apparatus being turned by lifting the front or rear at the end of each run.

Typically, the apparatus would include controls on the handle 12 such as throttle control, drive connection to the wheels and/or rotatable shafts and/or vacuum means.

Where a vacuum is applied to the surface being treated, the apparatus 10 includes a collection means for collecting material which may be retrieved from the surface being treated.

It will of course be realized that the above has been given only by way of illustrative example of the invention and that all such modifications and variations thereto as would be apparent to persons skilled in the art are deemed to fall within the broad scope and ambit of the invention as is claimed in the following claims.

What is claimed is:

1. A surface treatment apparatus comprising:

a) a housing;

b) a rotatable shaft in said housing;

c) impact means attached to said rotatable shaft for impacting a surface to be treated to dislodge a plurality of particulate material from the surface, the plurality of particulate material comprising a first dislodged particulate material and a second dislodged particulate material;

d) brush means mounted on said rotatable shaft and in alternate sequence with said impact means for brushing the surface to lift the plurality of dislodged particulate material from the surface;

e) drive means mounted in said housing for operating said impact means and said brush means;

f) induction means mounted on said housing for entraining a flow of the plurality of dislodged particulate material from said brush means;

g) discharge means communicating with said induction means for collecting the plurality of dislodged particulate material;

h) separation means communicating with said induction means for separating the first dislodged particulate material having a first density from the second dislodged particulate material having a second density which is greater than the first density of the first dislodged particulate material, the first dislodged particulate material being removed from the surface and collected by said discharge means and the second dislodged particulate material being returned to the surface; and i) carriage means communicating with said drive means for moving said surface treatment apparatus across the surface to be treated.

2. The surface treatment apparatus as claimed in claim 1, wherein said brush means comprises a first composite rotary brush assembly having circumferentially spaced rows of bristles mounted on said rotatable shaft in alternate circumferential sequence with said impact means.

3. The surface treatment apparatus as claimed in claim 1, wherein said induction means is so formed and arranged as to lift the first and the second dislodges particulate material above the surface to be treated to an elevation proportional to the density of the first and second dislodged particulate material.

4. The surface treatment apparatus as claimed in claim 2, wherein said impact means is pivotally mounted upon said rotatable shaft, said impact means comprising a plurality of longitudinally spaced hammers each pivotable about an axis substantially parallel to an axis of said rotatable shaft.

5. The surface treatment apparatus as claimed in claim 2, wherein said brush means includes a second rotary brush assembly mounted for contra-rotation relative to said first composite rotary brush assembly.

6. The surface treatment apparatus as claimed in claim 5, wherein said second rotary brush assembly and said first composite rotary brush assembly are mounted on spaced transverse shafts disposed substantially parallel to one another.

7. The surface treatment apparatus as claimed in claim 5, wherein said first composite rotary brush assembly and said second rotary brush assembly each rotate so their bristles move upwardly intermediate said respective shafts.

8. The surface treatment apparatus as claimed in claim 5, further comprising height adjustment means for adjusting an engagement between said impact means and said brush means with the surface to be treated.

9. The surface treatment apparatus as claimed in claim 8, wherein said heights adjustment means varies the height of said first composite rotary brush assembly and said second rotary brush assembly.

10. The surface treatment apparatus as claimed in claim 9, wherein said induction means comprises a particle inlet substantially intermediate said first composite and second rotary brush assemblies, an induction path leading to a blower assembly, and a blower outlet constituting said discharge means.

11. The surface treatment apparatus as claimed in claim 9, wherein said induction path includes an upstanding duct.

12. The surface treatment apparatus as claimed in claim 11, wherein said upstanding duct is formed by a tube connected between said particle inlet and said blower assembly.

13. A method for removing particulate material from a surface to be treated comprising the steps of:

i) providing a surface treatment apparatus comprising:

a) a housing;

b) a shaft in said housing;

c) impact means attached to said shaft for impacting a surface to be treated to dislodge a plurality of particulate material from the surface, the plurality of particulate material comprising a first dislodged particulate material and a second dislodged particulate material;

d) brush means mounted on said shaft and in alternate sequence with said impact means for brushing the surface to lift the plurality of dislodged particulate material from the surface;

e) drive means mounted in said housing for operating said impact means and said brush means;

f) induction means mounted on said housing for entraining a flow of the plurality of dislodged particulate material from said brush means;

g) discharge means communicating with said induction means for collecting the plurality of dislodged particulate material;

h) separation means communicating with said induction means for separating the first dislodged particulate material having a first density from the second dislodged particulate material having a second density which is greater than the first density of the first dislodged particulate material, the second dislodged particulate material being returned to the surface;

i) carriage means communicating with said drive means for moving said surface treatment apparatus across the surface to be treated; and j) a height adjustment means communicating with said housing for engaging contact between said impact means and said brush means with the surface to be treated;

ii) operating said brush means and said impact means by rotating said shaft;

iii) adjusting the height at which said brush means and said impact means contact the surface to be treated with said height adjustment means;

iv) passing said surface treatment apparatus over the surface to be treated;

v) dislodging the plurality of particulate material from the surface using said impact means;

vi) lifting the plurality of particulate material from the surface using said brush means;

vii) separating the first dislodged particulate material having a first density from the second dislodged particulate material having a second density which is greater than the first density of the first dislodged particulate material, the first dislodged particulate material being removed from the surface and collected by said discharge means and the second dislodged particulate material being returned to the surface.

14. The method as claimed in claim 13, further comprising adjusting the the height between said impact means and said brush means with the surface to be treated so that the impact means is substantially disengaged from the surface;

adjusting the the height between said impact means and said brush means with the surface to be treated so that said brush means is substantially in contact with the surface, and making a second passage of said surface treatment apparatus over the surface to be treated at a speed sufficient to permit the second dislodged particulate material particulate material to be substantially evenly distributed over said surface.

15. The method as claimed in claim 14, wherein said second passage substantially returns the second dislodged particulate material between upstanding piles of an artificial turf surface.

* * * * *